US005874710A

United States Patent [19]

Yoshimoto et al.

[11] Patent Number: 5,874,710

[45] Date of Patent: Feb. 23, 1999

[54] FIXING HEATER AND FIXING APPARATUS WITH TRIMMED RESISTIVE MEMBER

[75] Inventors: Toshio Yoshimoto, Yokohama; Takashi Soya, Kawasaki; Takashi Nakahara, Kawasaki; Yasumasa Nashida, Kawasaki; Yasuhiro Nakata, Yokohama, all of Japan

[73] Assignee: Canon Kabushiki Kaisha, Tokyo, Japan

[21] Appl. No.: 844,622

[22] Filed: Apr. 21, 1997

Related U.S. Application Data

[63] Continuation of Ser. No. 168,508, Dec. 22, 1993, abandoned.

[30] Foreign Application Priority Data

Dec. 29, 1992 [JP] Japan ..... 4-361597

[51] Int. Cl.[6] ..... G03G 15/20

[52] U.S. Cl. ..... 219/216; 219/121.68; 399/329

[58] Field of Search ..... 219/216, 543, 219/121.68, 121.69; 338/195; 399/328, 329, 338

[56] References Cited

U.S. PATENT DOCUMENTS

| | | | |
|---|---|---|---|
| 3,889,223 | 6/1975 | Sella et al. | 338/195 |
| 4,146,673 | 3/1979 | Headley | 219/121.69 |
| 4,284,970 | 8/1981 | Berrin et al. | 338/195 |
| 5,148,226 | 9/1992 | Setoriyama et al. . | |
| 5,149,941 | 9/1992 | Hirabayashi et al. . | |
| 5,262,834 | 11/1993 | Kusaka et al. . | |
| 5,268,558 | 12/1993 | Youssef et al. | 219/543 |
| 5,288,973 | 2/1994 | Ota et al. | 219/216 |
| 5,338,919 | 8/1994 | Tagashira et al. | 219/543 |
| 5,587,097 | 12/1996 | Sato et al. | 219/543 |

FOREIGN PATENT DOCUMENTS

| | | |
|---|---|---|
| 0494627 | 7/1992 | European Pat. Off. . |
| 0546495 | 6/1993 | European Pat. Off. . |
| 0546545 | 6/1993 | European Pat. Off. . |
| 5-216360 | 8/1993 | Japan . |

*Primary Examiner*—Gregory L. Mills

*Attorney, Agent, or Firm*—Fitzpatrick, Cella, Harper & Scinto

[57] ABSTRACT

A fixing heater includes a dielectric substrate, a resistor formed on the substrate and Laser-trimmed in a current flow direction, a slidable film, and backup member forming a nip with the film. The trimmed portion lies outside the nip.

8 Claims, 5 Drawing Sheets

FIXING HEATER AND FIXING APPARATUS WITH TRIMMED RESISTIVE MEMBER

This application is a continuation of application Ser. No. 08/168,508 filed Dec. 22, 1993, now abandoned.

FIELD OF THE INVENTION AND RELATED ART

The present invention relates to a fixing apparatus of a through-film heating type and a fixing heater employed in such a fixing apparatus.

The image heating apparatus comprising this through-film type heating system has been proposed in U.S. Pat. No. 5,149,941; or the like. Such a heating apparatus comprising a through-film heating type affords the use of a heater with a low thermal capacity, the temperature of which can be quickly raised, and a thin film; therefore, it has advantages such as reduction in power consumption and waiting time (it quickly starts up). Simply stated, it is very effective.

As for the heating member, a so-called ceramic heater is employed, which basically comprises a heat resistant dielectric substrate and an electrically heat generating resistor formed thereon, wherein heat is generated by supplying electric power to the resistor.

FIG. 4 shows the general structure of the fixing apparatus disclosed in U.S. Ser. No. 712,532; and U.S. Pat. No. 5,148,226.

A reference numeral 1 designates a trough-like internal film guide member (stay) which is made of heat resistant and thermally insulating material, and the cross-section of which is roughly in the form of a semicircle. This guide member 1 is provided with a groove which runs at the approximate center of the downward facing external surface, in the longitudinal direction of the guide member 1. In this groove, a ceramic heater 2 as the heating member with a low thermal capacity is supported by being embedded in it.

Around this internal film guide 1 comprising the heater 2, a heat resistant cylindrical fixing film 3 is loosely fitted. In other words, it is arranged so that the internal peripheral length of the cylindrical fixing film 3 is slightly longer, for example, by 3 mm or so, than the external peripheral length of the internal film guide 1 comprising the heater 2. That is, the film 3 loosely fits around the guide member 1 comprising the heater 2, with room to spare in its peripheral length.

A reference numeral 4 designates a pressure roller as a pressing member (pressure-contact roller, backup roller), which comprises, for example, a metallic core and a heat resistant, separative rubber layer formed co-axially thereon, of material such as silicon rubber. The pressure roller 4 is placed in contact with the heater 2, with a predetermined pressure (for example, overall pressure of 3–6 kg across the width of an A4 sheet) and with the film 3 being interposed between the pressure roller 4 and the heater 2. On one end of the shaft of the pressure roller 4, a gear (unshown) is fixed, which engages with a gear (unshown) of the driving system of the main assembly of the image forming apparatus, whereby the pressure roller 4 is rotatively driven at a predetermined peripheral velocity, which in turn rotates the cylindrical fixing film 3 around the internal film guide 1 because of the friction between the surfaces of the pressure roller 4 and the film 3, with the film 3 being firmly in contact with the bottom surface of the heater 2.

While the film is rotating in the above-mentioned manner, a recording material P as a member to be heated is introduced between the film 3 and pressure roller 4, carrying an unfixed toner image T. Then, the recording material P is firmly pressed on the rotating film 3 and is passed together with the film 3 through a fixing nip N, during which the thermal energy from the heater 2 is transferred through the film 1 to the recording material P, fixing thermally the toner image T.

Thus, because of the contact pressure generated by the rotary pressure roller 4 against the heater 2, the recording material P is conveyed at the same speed as the fixing film 3 and pressure roller 4, without slipping at least within the fixing nip N. During this process as the heating and pressing process in which the recording material is passed through the fixing nip, the heat from the heater 2 is transferred through the fixing film 3 to the recording material, whereby the unfixed toner image T is melted and pressed.

After being passed through the fixing nip N, the fixing film 3 and recording material P are continuously advanced while being still firmly adhered to each other because of the adhesiveness of the melted and softened toner T. This conveying process serves as a cooling process, during which the heat is radiated from the melted and softened toner T, whereby the toner T cools down to solidify, becoming a permanent solid image on the recording material P. After the cooling process, the fixing film 3 and recording material P is easily separated because of the curvature of the film surface and because the solidified toner does not have much adhesiveness, and then, the recording material P is discharged from the apparatus.

In order to reduce the thermal capacity of the fixing film 3 so that the heating apparatus can offer a faster response, the film thickness is preferred to be less than 100 $\mu$m, more preferably, no more than 50 $\mu$m and no less than 20 $\mu$m; a monolayer film of PTFE, PFA, FEP, or the like, which is heat resistant, toner-separative, and tough, or a multilayer film comprising a cylindrical base film of polyimide, polyamideimide, PEEK, PES, PPS, or the like, and a layer of PTFE, PFA, FEP, or the like, coated on the outward facing surface of the base film, may be used. In this embodiment, the multilayer film is employed, which comprises a cylindrical polyimide base film and a layer of PTFE coated on the outward facing surface of the base film.

The ceramic heater 2 as the heating member basically comprises a ceramic base plate (substrate) 21, made of highly heat resistant dielectric material such as alumina ($Al_2O_3$) and having a low thermal capacity, and an electrically heat generating resistor 22 formed on the outward facing surface of this base plate in a manner to extend in the longitudinal direction of the base plate; needless to say, its overall thermal capacity is small. It is positioned in the heating apparatus in such a manner that its longitudinal direction is perpendicular to the conveyance direction of the recording material P (perpendicular to the surface of the drawing).

As to the formation of the heat generating resistor 22, the heat generating material such as $TaSiO_2$, Ag/Pd, $RuO_2$, $Ta_2N$, nichrome, PdO, Pd, Ag, $Bi_2Ru_2O_7$, or the like, or pastes of the preceding materials, are placed on the ceramic substrate 21, on the outward facing surface, to a thickness of approximately 10 $\mu$m in a manner to form a 1–3 mm wide line or narrow band extending in the longitudinal direction of the ceramic substrate 21 approximately in the middle, using the vapor deposition, sputtering, CVD, screen printing, or the like.

A reference numeral 23 designates a protective layer made of glass, fluorinated resin, or the like, which coats the heat generating resistor 22 and the surface of the ceramic base plate 21 on which the resistor 22 has been formed. A reference numeral 24 designates a thermistor as a temperature detecting element provided on the rear surface of the ceramic base plate 21. The ceramic heater 2 constructed in the above-mentioned manner is embedded and fixed with heat resistant adhesive or the like, in the groove provided on the outward facing surface, that is, the bottom surface, of the internal film guide member 1, with the surface on which the heat generating resistor was formed facing downward.

The temperature of the entire heater 2 quickly rises as a current is flowed between the longitudinal opposite ends of the heat generating resistor 22. Then, the temperature increase of the heater 2 is detected by the thermistor 24. The output of the thermistor 24 is A/D converted and is taken in as control data by a microcomputer 11, which uses the data to control through a triac 12 an AC voltage applied from an AC power source 13 to the heat generating resistor 22 of the heater 2. In other words, the AC voltage is controlled by phase control, wave number control, pulse width modulation, or the like, to control the power supplied to the heat generating resistor 22 of the heater 2, so that the temperature of the heater 2 is controlled to remain at a predetermined fixing temperature.

Therefore, it is preferable that there is no variance in the heat generating capacity among the heaters 2 for this through-film heating system that is, that each heater 2 is capable of generating the same predetermined amount of heat when a predetermined amount of power is supplied.

However, it was rather difficult to provide a number of resistors 22 with exactly the same resistance values, with no variance; therefore, there was variance in the amount of heat each resistor generated.

SUMMARY OF THE INVENTION

Accordingly, a primary object of the present invention is to provide a fixing heater in which the resistance value of the resistor is accurate.

Another object of the present invention is to provide a fixing apparatus in which the resistance value of the resistor can be corrected after the baking of the resistor.

According to an aspect of the present invention, the fixing heater comprises a dielectric substrate; a resistor formed on the substrate and trimmed in such a manner that the trimming line runs in the current flow direction.

According to another aspect of the present invention, a fixing apparatus comprises: a heater comprising a dielectric substrate and a resistor formed on the substrate and trimmed in such a manner that the trimming line runs in the current flow direction; a film which slides on the heater; a backup member which coordinates with the heater to form a nip, with the film being interposed; wherein the trimmed portion of the resistor is positioned outside the nip.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Figure 4:
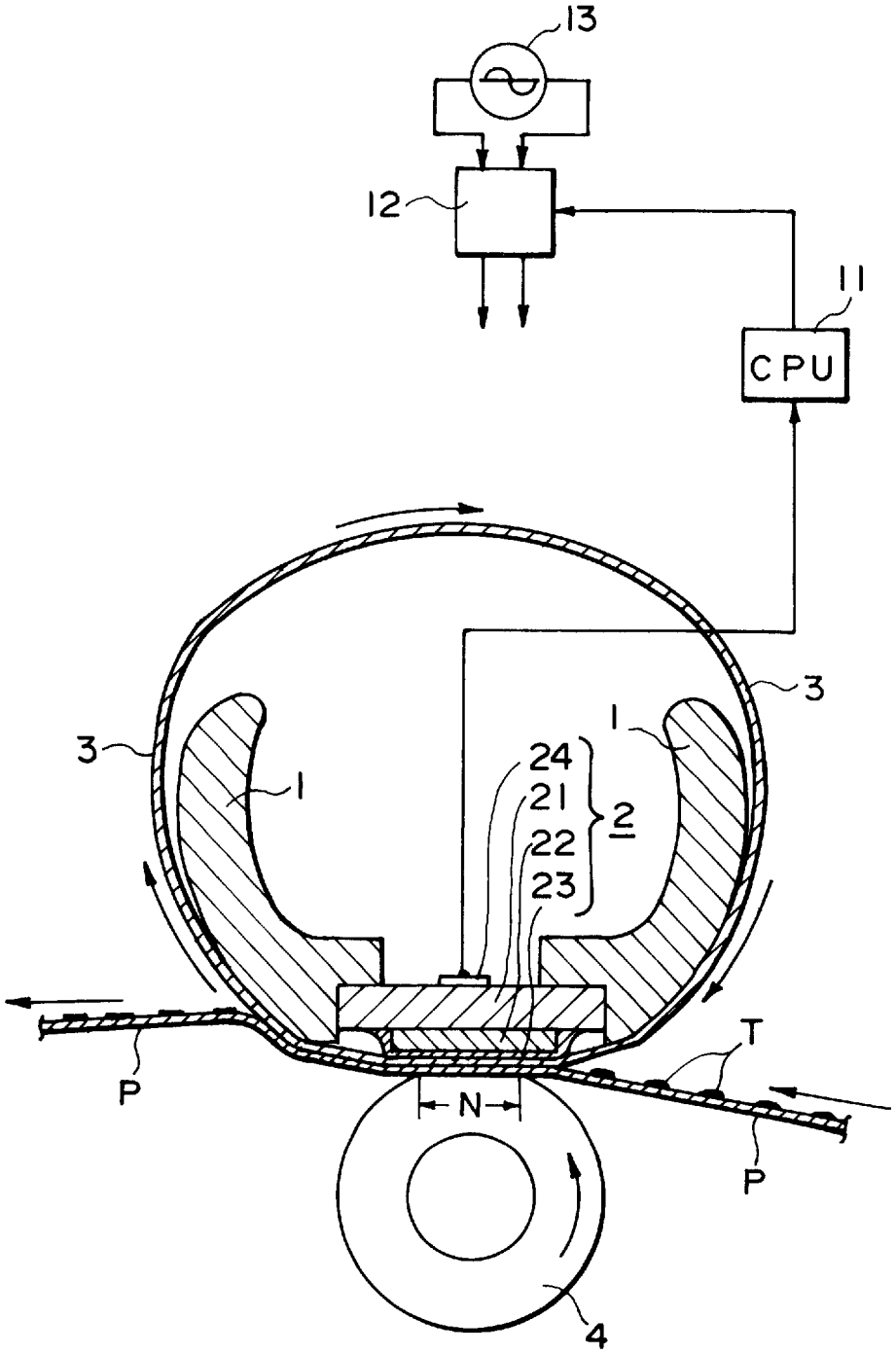
FIG. 4 is a sectional view of an embodiment of a through-film type heating apparatus.

Hereinafter, the preferred embodiments of the present invention will be described and the same components as those shown in FIG. 4 will be designated by the same reference symbol so that repetition of descriptions will be omitted.

Figure 5A:
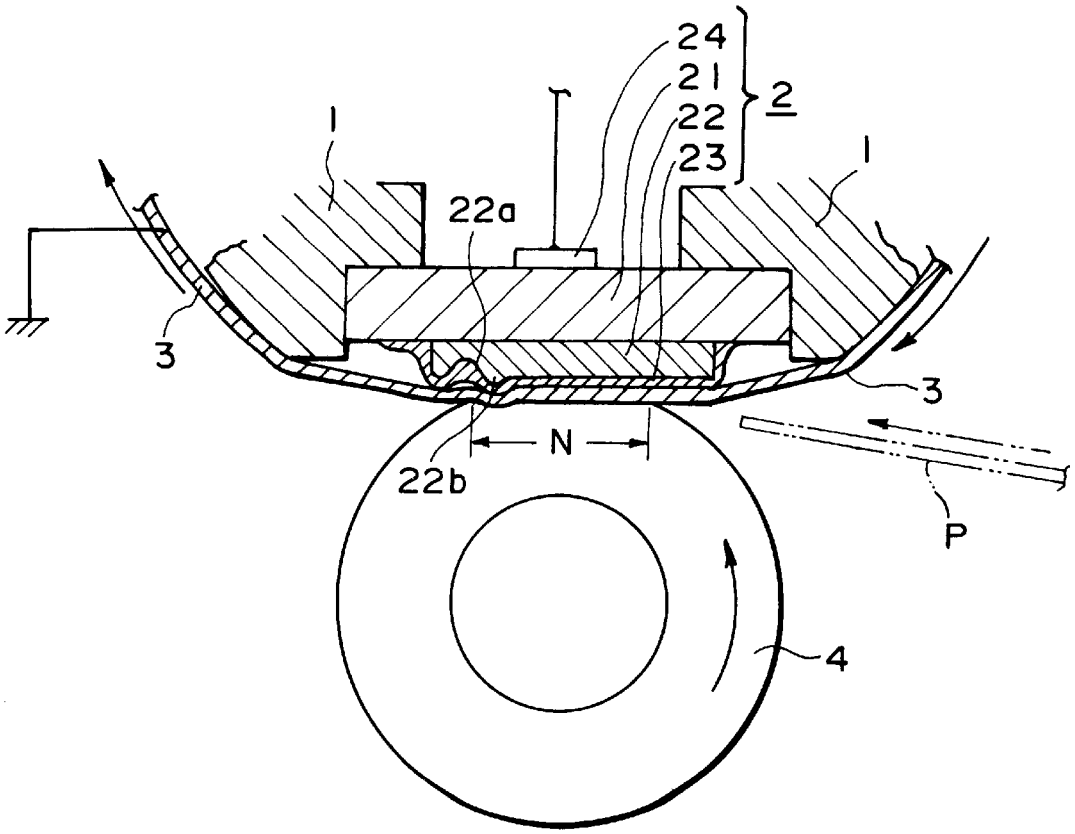
FIG. 5(*a*) is an enlarged sectional view of a portion of another alternative embodiment of the present invention, and FIG. 5(*b*) is an oblique view of a portion of a heater.
Figure 5B:
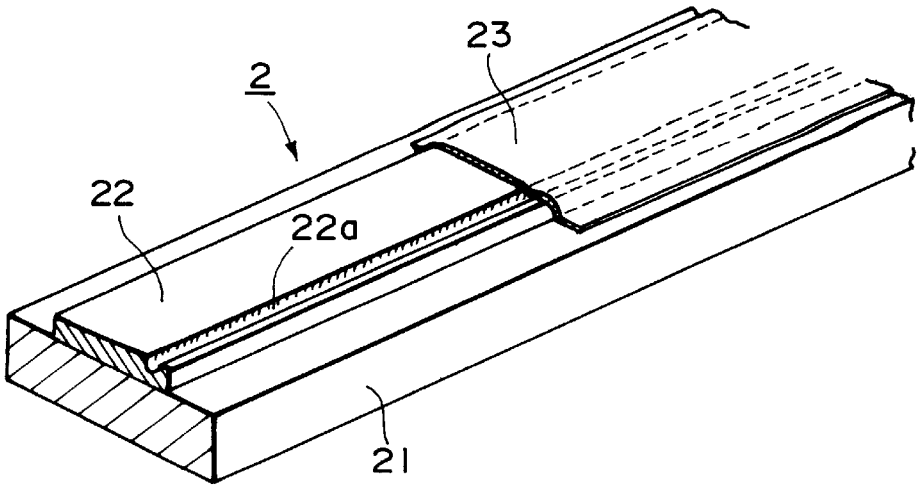

FIG. 5 shows one of the embodiments of the present invention, wherein FIG. 5(*a*) is an enlarged schematic of the fixing nip portion, and FIG. 5(*b*) is a partially cutaway oblique view (schematic) of the ceramic heater 2, with the outward facing surface facing upward.

After the heat generating resistor 22 is formed on the ceramic base plate 21, its resistance value is adjusted. In other words, it is trimmed by a proper amount along one of the longitudinal edges using a laser or the like before the protective layer 23 is formed, so that its overall resistance value (total resistance value) falls within a predetermined range.

In FIGS. 5(*a*) and 5(*b*), a reference symbol 22*a* designates a groove (laser-trimmed portion) created in the longitudinal direction of the heat generating resistor during the trimming of the heat generating resistor 22. That is, the groove 22*a* is where the heat generating resistor was worked on to adjust the overall resistance value.

By controlling the variance in the overall resistance value among the heat-generating resistors 22 in the above-mentioned manner, it becomes easier to control the temperature of the thermal fixing apparatus, that is, to reduce the ripples in the controlled temperature. Generally speaking, the variance in the overall resistance value can be reduced to a range of ±3%–2% by the trimming, whereas the variance is ±10% without the trimming.

After the heat generating resistor 22 is trimmed by the amount equal to the volume of the groove 22*a* to correct the overall resistance value, the protective layer 23 is coated.

In other words, the resistors formed (baked) on the dielectric substrate are trimmed to correct their resistance values so that the variance in the heat generation among the resistors can be minimized. However, the trimming procedure brings forth a different problem, which will be described below.

Referring to FIG. 5(*a*) showing a preferred embodiment of the present invention, the resistor has developed a ridge (swelling) 22*b* along one of the edges of the trimmed portion 22*a* (groove), and this trimmed portion 22*a* falls within the nip, which causes the following problems.

(1) As the film 3 rotates by being subordinated to the rotation of the pressure roller 4, the film 3 sometimes develops scratches or tears because of the ridge 22*b*.

(2) Since the protective layer 23 such as a glass coat becomes thinner over the ridge 22*b* compared to other portion, insulation at this point becomes weak; therefore, when the film 3 is grounded through the frame of the fixing apparatus, the protective layer 23 cannot function as an adequate insulator.

(3) Minute foreign matter or the like settles in the trimmed portion 22*a* (groove), which is liable to cause the scratches on the film 3.

(4 ) Since the surface of the protective layer 23 is not flat, the pressure from the pressure roller 4 concentrates on the ridge of the protective layer, which is liable to cause the protective layer such as glass coat to chip.

Next, the preferred embodiments of the fixing apparatus in which the problems described in the foregoing are eliminated will be described.

Figure 1:
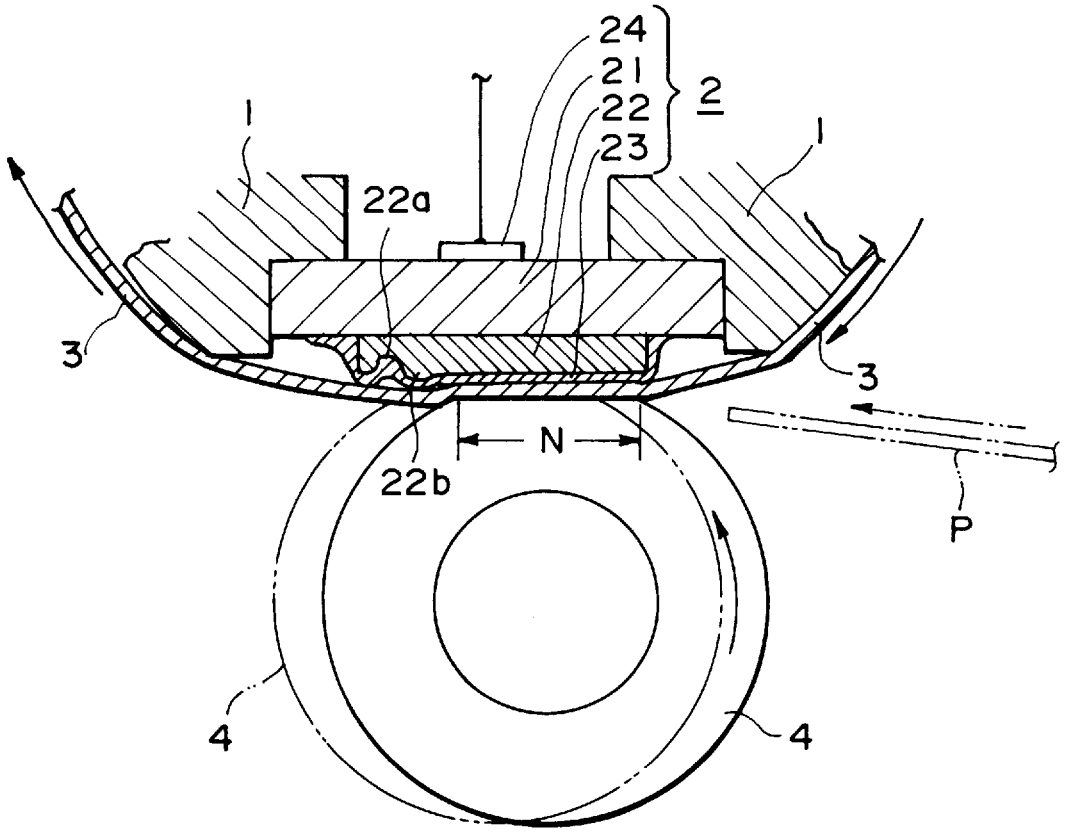
FIG. 1 is an enlarged sectional view of a portion of a preferred embodiment of the present invention.

FIG. 1 is an enlarged section of a portion of one of the preferred embodiments of the present invention.

In this embodiment, the pressure roller 4 is displaced to the right, that is, to the upstream side of the nip N with reference to the direction in which the recording material is moved, so that the trimmed portion 22*a* and ridge 22*b*, where the heat generating resistor 22 was worked on in order to adjust the overall resistance value, is moved out of the fixing nip N, that is, are going to be located on the downstream side of the nip N with reference to the direction in which the film 3 and recording material P move. In other words, they are positioned away from the fixing nip N.

Since the film 3 is not directly pressed by the pressure roller 4, at the portion facing the trimmed portions 22*a* (groove) and the adjacent ridge 22*b*, the probability at which the scars, tears or the like are caused on the film 3 by the trimmed portion 22*a* (groove) or ridge 22*b* becomes extremely small compared to the apparatus shown in FIG. 5(*a*).

Figure 2A:
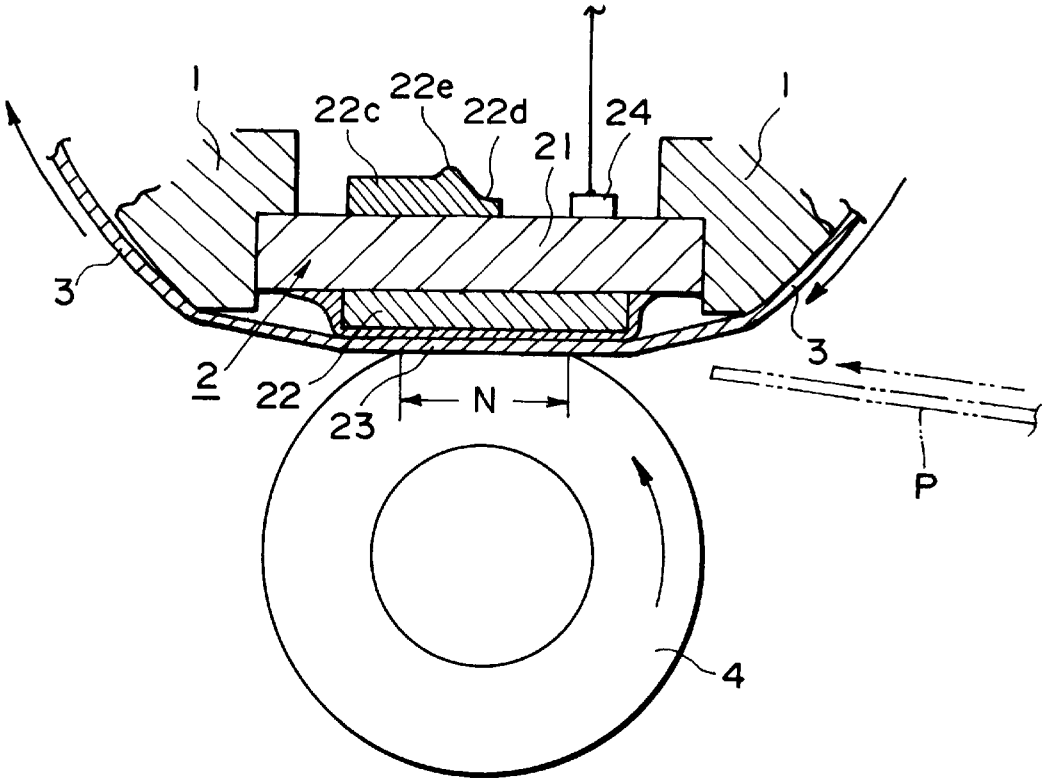
FIG. 2(*a*) is an enlarged sectional view of a portion of an alternative embodiment of the present invention, and FIG. 2(*b*) is an equivalent circuit.
Figure 2B:
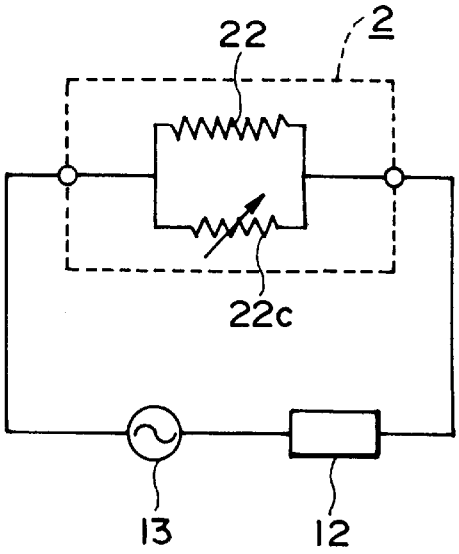

FIG. 2 shows an alternative embodiment of the present invention.

Referring to FIG. 2(*a*), the apparatus of this embodiment is provided with an additional heat generating resistor 22*c* formed on the rear surface of the base plate 21, besides the heat generating resistor 22 on the front surface of the ceramic base plate 21. Both resistors 22 and 22*c* are connected in parallel to the power supply circuit as shown in FIG. 2(*b*). As for the correction of the overall resistance value, the heat generating resistor 22 on the front surface of the heater is not trimmed and instead the additional heat generating resistor 22*c* on the rear surface of the heater is trimmed at a portion 22*d*.

According to this arrangement, the trimmed heat generating resistor does not come in contact with the film 3 at all; therefore, even if there is the groove or ridge 22*e* which develops when the heat generating resistor 22*c* is trimmed at the portion 22*d*, the problems of scars, tears or the like do not occur to the film 3.

Figure 3:
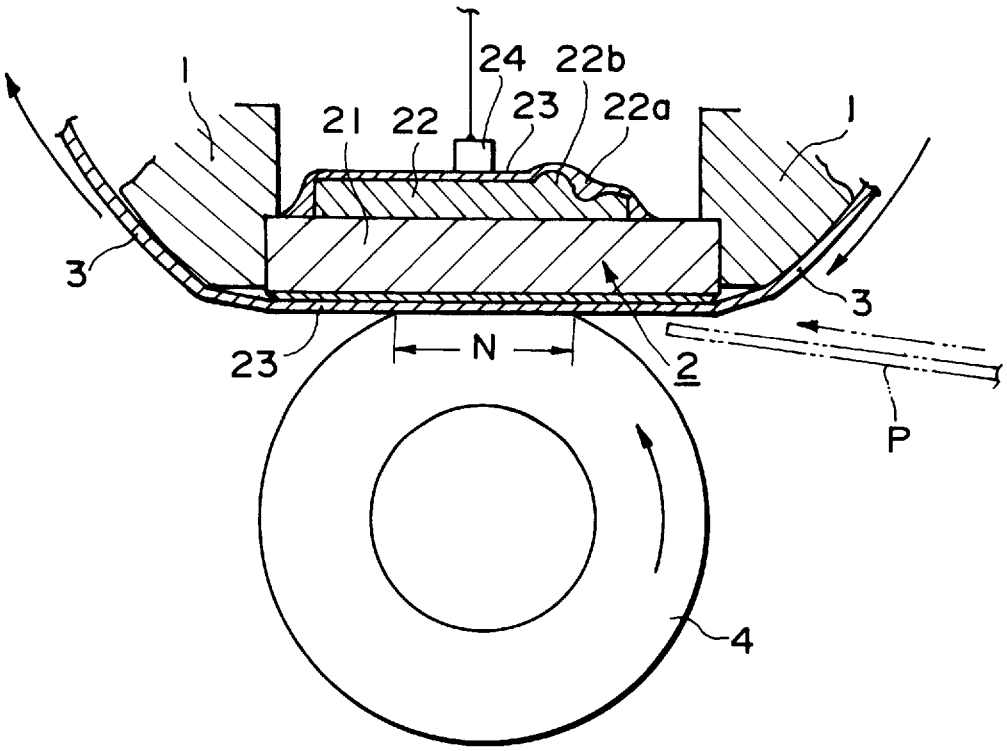
FIG. 3 is an enlarged sectional view of another alternative embodiment of the present invention.

FIG. 3 shows another alternative embodiment of the present invention.

In this embodiment, the heat generating resistor 22 is provided on the rear surface of the ceramic base plate 21 and only protective layer 23 such as a glass coat or the like is provided on the outward facing surface of the ceramic base plate 21 on which the film 3 slides.

These and other objects, features and advantages of the present invention will become more apparent upon a consideration of the following description of the preferred embodiments of the present invention, taken in conjunction with the accompanying drawings

What is claimed is:

1. An image fixing apparatus comprising:

a heater having a substrate and a resistor generating heat upon electric energy supply thereto, wherein said resistor has a portion trimmed along a direction of electric energy supply;

a film in slidable contact with said heater, wherein said film is movable in a direction perpendicular to the direction of electric energy supply; and a backup member for forming a nip with said heater with said film therebetween, wherein the trimmed portion is located entirely outside the nip and extends over an entire length of the resistor.

2. A fixing apparatus according to claim 1, wherein said heater further comprises a protection layer for covering said resistor and said film slides on said protection layer.

3. A fixing apparatus according to claim 1, wherein said resistor is formed to extend in a direction perpendicular to the moving direction of said film and is supplied with power through the opposite ends.

4. A fixing apparatus according to claim 1, wherein said substrate is made of ceramic material.

5. A fixing apparatus according to claim 1, wherein said resistor is formed on a surface of said substrate facing said nip and the trimmed portion of said resistor is located on a downstream side of said nip with respect to the moving direction of said film.

6. A fixing apparatus according to claim 1, wherein said apparatus further comprises: a temperature detecting element for detecting a temperature of said substrate, and a power supply controlling means for controlling power supply to said resistor so that the temperature detected by said temperature detecting member remains at a predetermined fixing temperature.

7. A fixing apparatus according to claim 1, wherein said substrate is electrically insulative.

8. A fixing apparatus according to claim 1, wherein the unfixed image is fixed on the recording material by the nip, while recording material is by said nip.

* * * * *

UNITED STATES PATENT AND TRADEMARK OFFICE

CERTIFICATE OF CORRECTION

PATENT NO. : 5,874,710

DATED : February 23, 1999

INVENTOR(S) : TOSHIO YOSHIMOTO, ET AL.

It is certified that error appears in the above-identified patent and that said Letters Patent is hereby corrected as shown below:

COLUMN 3,
Line 11, "is flowed" should read --flow--.

COLUMN 6,
Line 27, "the" should read --a--.

Signed and Sealed this

Twenty-second Day of February, 2000

*Attest:*

Q. TODD DICKINSON

*Attesting Officer*

*Commissioner of Patents and Trademarks*